US011555361B2

(12) United States Patent
Mydland et al.

(10) Patent No.: US 11,555,361 B2
(45) Date of Patent: Jan. 17, 2023

(54) CRANE YOKE, CRANE AND METHOD FOR HANDLING TUBULARS

(71) Applicant: MHWIRTH AS, Kristiansand S (NO)

(72) Inventors: Petter Mydland, Kristiansand S (NO); Even Karlsen, Kristiansand (NO); Geir Lien, Hoevag (NO)

(73) Assignee: MHWIRTH AS, Kristiansand S (NO)

( * ) Notice: Subject to any disclaimer, the term of this patent is extended or adjusted under 35 U.S.C. 154(b) by 46 days.

(21) Appl. No.: 17/048,611

(22) PCT Filed: Apr. 4, 2019

(86) PCT No.: PCT/NO2019/050069
§ 371 (c)(1),
(2) Date: Oct. 19, 2020

(87) PCT Pub. No.: WO2019/203655
PCT Pub. Date: Oct. 24, 2019

(65) Prior Publication Data

US 2021/0180415 A1 Jun. 17, 2021

(30) Foreign Application Priority Data

Apr. 20, 2018 (NO) ..... 20180545

(51) Int. Cl.

| | |
|---|---|
| ***E21B 19/15*** | (2006.01) |
| ***B66C 1/04*** | (2006.01) |
| ***B66C 1/22*** | (2006.01) |
| ***B66C 23/18*** | (2006.01) |

(52) U.S. Cl.
CPC ..... *E21B 19/15* (2013.01); *B66C 1/04* (2013.01); *B66C 1/22* (2013.01); *B66C 23/18* (2013.01)

(58) Field of Classification Search
CPC .... B65G 59/066; B65G 33/06; B65G 59/107; B65G 59/108; B65G 15/14; B65G 1/0442; B65G 1/08; E21B 19/15; E21B 7/046; E21B 19/083; E21B 19/14; E21D 20/003
See application file for complete search history.

(56) References Cited

U.S. PATENT DOCUMENTS

| | | | | |
|---|---|---|---|---|
| 3,616,941 A | | 11/1971 | Walling | |
| 3,658,194 A | * | 4/1972 | Gendron | B65G 59/107 414/795.8 |
| 3,858,731 A | * | 1/1975 | Briggs | F16L 1/0243 414/745.9 |
| 3,986,618 A | | 10/1976 | Woolslayer et al. | |
| 4,388,039 A | * | 6/1983 | Schwarze | B21D 43/006 221/202 |
| 4,955,783 A | * | 9/1990 | Grazia | B65B 35/52 414/795 |

(Continued)

FOREIGN PATENT DOCUMENTS

| | | | | |
|---|---|---|---|---|
| CN | 106194066 A | * | 12/2016 | E21B 19/14 |
| DE | 100 23 100 C1 | | 9/2001 | |

(Continued)

*Primary Examiner* — Gregory W Adams
(74) *Attorney, Agent, or Firm* — Norman B. Thot

(57) ABSTRACT

A yoke for a pipe handling crane. The yoke includes a magazine having storage slots for tubular pipes, and a pipe lifting unit having a lifting tool. The lifting tool supplies a tubular pipe to and retrieves a tubular pipe from the magazine.

15 Claims, 10 Drawing Sheets

(56) References Cited

U.S. PATENT DOCUMENTS

| | | | | | |
|---|---|---|---|---|---|
| 4,982,891 | A * | 1/1991 | Kimura | B21D 11/10 | 414/745.9 |
| 5,458,454 | A * | 10/1995 | Sorokan | E21B 19/155 | 414/22.55 |
| 7,600,584 | B2 * | 10/2009 | Sewell | E21B 7/046 | 166/85.1 |
| 7,794,192 | B2 * | 9/2010 | Wright | E21B 19/14 | 414/23 |
| 8,474,549 | B2 * | 7/2013 | Piipponen | E21D 20/003 | 175/52 |
| 8,562,269 | B2 * | 10/2013 | Hermes | E21B 19/15 | 414/751.1 |
| 2001/0045301 | A1 | 11/2001 | Bayer et al. | | |
| 2002/0153169 | A1 | 10/2002 | Sewell | | |
| 2003/0170095 | A1 | 9/2003 | Slettedal | | |
| 2009/0053015 | A1 | 2/2009 | Zachariasen et al. | | |
| 2011/0315446 | A1 | 12/2011 | Salthaug | | |
| 2015/0048038 | A1 | 2/2015 | Roodenburg et al. | | |

FOREIGN PATENT DOCUMENTS

| | | | | |
|---|---|---|---|---|
| DE | 10104337 | A1 * | 8/2002 | E21B 19/15 |
| WO | WO 01/51762 | A1 | 7/2001 | |
| WO | WO 2006/096068 | A1 | 9/2006 | |
| WO | WO 2010/087710 | A1 | 8/2010 | |
| WO | WO 2013/141697 | A2 | 9/2013 | |
| WO | WO-2014105050 | A1 * | 7/2014 | E21B 19/15 |
| WO | WO-2016181272 | A1 * | 11/2016 | |

* cited by examiner

CRANE YOKE, CRANE AND METHOD FOR HANDLING TUBULARS

CROSS REFERENCE TO PRIOR APPLICATIONS

This application is a U.S. National Phase application under 35 U.S.C. § 371 of International Application No. PCT/NO2019/050069, filed on Apr. 4, 2019 and which claims benefit to Norwegian Patent Application No. 20180545, filed on Apr. 20, 2018. The International Application was published in English on Oct. 24, 2019 as WO 2019/203655 A1 under PCT Article 21(2).

FIELD

The present invention relates to a crane yoke and to a crane for handling tubulars, including but not limited to tubulars used in drilling operations, as well as to a method for moving a pipe between a pipe storage and a drilling operation.

BACKGROUND

In various industrial processes, it is necessary to handle tubular elements between, for example, a tubular storage, a tubular handling machine, and a place of use of the tubular. One example of such processes is drilling operations where tubulars, such as sections of a drill string or other types of pipe, are used in a wellbore. In such drilling operations, which can include offshore or onshore operations, the pipe elements are commonly transported between a storage area (for example, a pipe deck) to a pipe handling machine on a drill floor by the use of a crane. This transport may be done both ways: from the storage to the drill floor during construction of a tubular string (such as for drilling or tripping in), and from the drill floor to the storage during retrieval of the string from the wellbore (such as tripping out a drill string).

Such operations involving transport of individual tubular elements or a bundle of tubular elements will usually have stringent health and safety requirements as there will often be the need for personnel to work on, for example, the pipe deck and the drill floor, at the same time as tubulars are being moved. There is also a continuous need to make such operations as efficient as possible in order to reduce downtime of the overall plant and industrial processes. There is finally a need to reduce, as much as possible, energy use and wear on machines involved in such operations.

Documents which may be useful for providing background information include WO 2006/096068 A1, WO 2010/087710 A1 and US 2002/153169 A1.

SUMMARY

An aspect of the present invention is to provide systems and methods which provide improvements over known solutions and techniques in one or more of the above areas, or other areas.

In an embodiment, the present invention provides a yoke for a pipe handling crane. The yoke includes a magazine comprising a plurality of storage slots for tubular pipes, and a pipe lifting unit comprising a lifting tool. The lifting tool is configured to supply one of the tubular pipes to and retrieve one of the tubular pipes from the magazine.

BRIEF DESCRIPTION OF THE DRAWINGS

The present invention is described in greater detail below on the basis of embodiments and of the drawings in which.

DETAILED DESCRIPTION

In an embodiment, the present invention provides a yoke for a pipe handling crane, the yoke comprising a pipe lifting unit and a magazine, the magazine comprising a plurality of storage slots for tubular pipes, wherein the pipe lifting unit comprises a lifting tool operable to supply a pipe to and retrieve a pipe from the magazine.

In an embodiment, the present invention provides a crane comprising a yoke.

In an embodiment, the present invention provides a method of moving a pipe between a pipe storage and a drilling operation, the method comprising the steps: operating a crane having a yoke to pick up a plurality of pipes from the pipe storage and to store the pipes in a magazine, and delivering the pipes from the magazine to a pipe handling machine associated with the drilling operation.

Various characteristics will become clear from the following description of illustrative embodiments, which are given as non-restrictive examples, under reference to the attached drawings.

Figure 1:
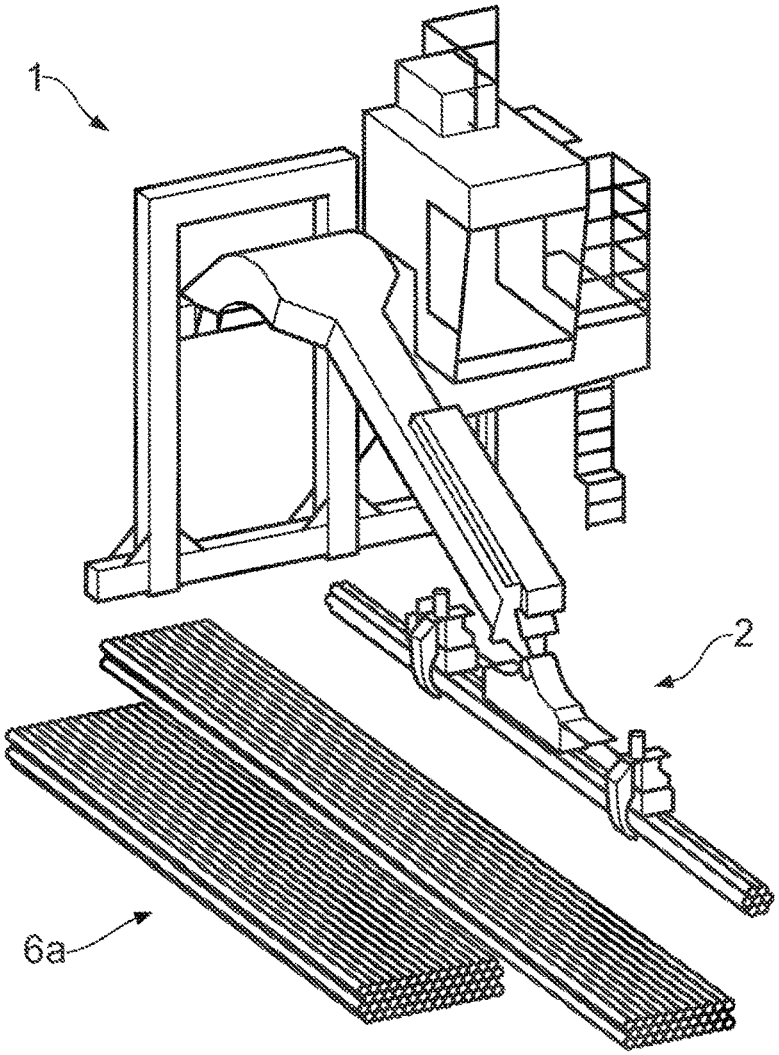
Fig. 1 (Prior Art)
FIG. 1 shows a prior art pipe handling crane.

FIG. 1 shows one illustrative application of a pipe handling crane 1 according to the prior art. The pipe handling crane 1 operates on a drilling rig and in particular above a pipe deck having a plurality of pipes 6*a* stored thereon. The pipes 6*a* may be stored in racks or lie on the pipe deck, for example, on rails or another type of support. The pipe handling crane 1 has a yoke 2 for picking up pipes and to supply pipes to, for example, a pipe handling machine associated with the drilling plant on the rig. The yoke 2 has a pipe lifting unit, in this example, a pipe clamp, which is capable of picking up and holding one or more pipes.

Figure 2:
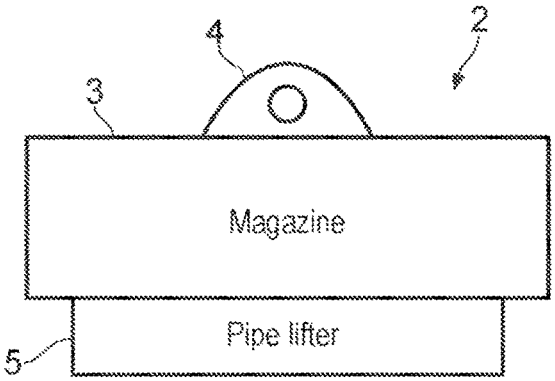
FIG. 2 shows a yoke according to an embodiment of the present invention.

FIG. 2 illustrates a yoke 2 for a pipe handling crane 1 according to an embodiment of the present invention. The yoke 2 comprises a pipe lifting unit 5 and a magazine 3 for storing a plurality of elongate elements, such as pipe sections. An example of such pipe sections are pieces of drill pipe used for drilling operations. In this embodiment, the magazine 3 is arranged above the pipe lifting unit 5, however, the magazine 3 may also be arranged partially above, side-by-side or in another configuration in relation to the pipe lifting unit 5.

A connection 4 for fixing the yoke 2 to the pipe handling crane 1 is also schematically illustrated.

Figure 3:
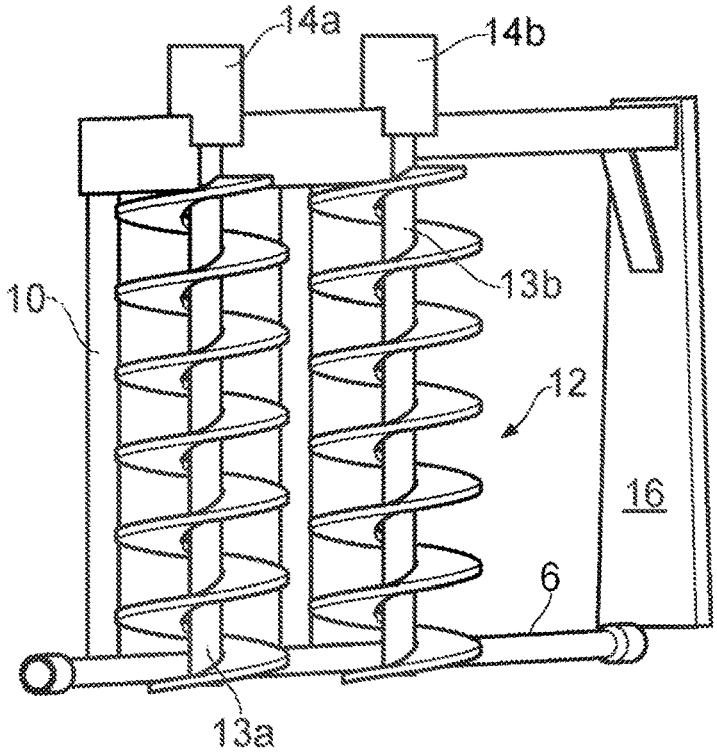
FIG. 3 shows a first view of a yoke magazine according to an embodiment of the present invention.
Figure 4:
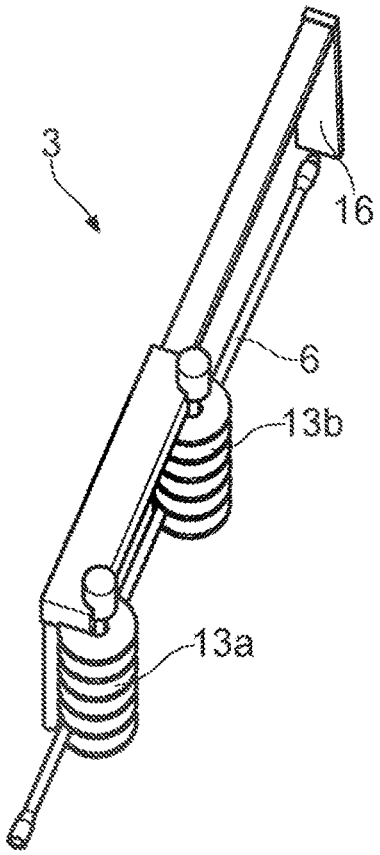
FIG. 4 shows a second view of a yoke magazine according to an embodiment of the present invention.
Figure 5:
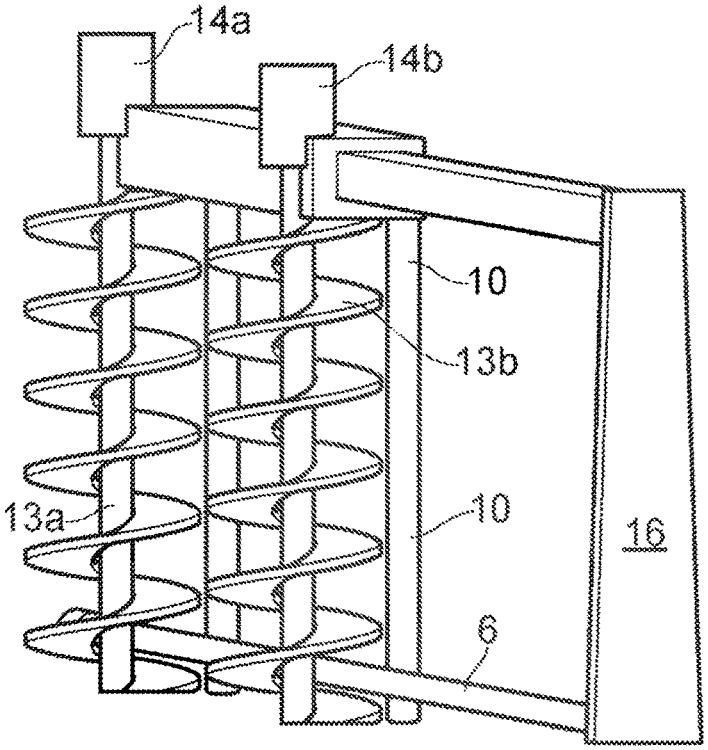
FIG. 5 shows a third view of a yoke magazine according to an embodiment of the present invention.

FIGS. 3-5 illustrate an embodiment of a magazine 3. The magazine 3 comprises a plurality of storage slots 12 for tubular pipes 6, which the pipe lifting unit 5, via a lifting tool (an example of which is described in greater detail below), is able to supply with a pipe 6 and to retrieve a pipe 6 from.

In this embodiment, the plurality of storage slots 12 are provided by two vertically arranged screw elements 13*a,b* having a helix-shaped support surface for the pipes 6. Each screw element 13*a,b* defines a plurality of support slots for supporting a pipe 6 in the helix, and pairs of support slots make up each storage slot 12. FIGS. 3-5 show an example with only one pipe 6 in the lowermost slot. One or more vertical support rails 10 are arranged to provide radial support for pipes 6 arranged in the magazine 3 so that the pipe 6 is held in place by the helix-shaped support surface with the support rail 10 providing sideways, radial support.

One or more end supports 16 may be arranged to provide longitudinal support for pipes 6 arranged in the magazine 3. Only one end support 16 is shown in this embodiment for clarity. The end support 16 prevents the pipe 6 from sliding longitudinally and out of the respective storage slot 12. Whether an end support 16 is required will depend on the specific requirements in each application. The end support 16 may, for example, be advantageous if the yoke 2 is used on an offshore rig which operates in harsh weather, i.e., sea motion exists. Alternatively, if the requirements and operating conditions permit, such longitudinal support can be provided by suitable high-friction materials on the support surface of the storage slots 12 or, for example, a separate mechanism can be used to selectively clamp the pipe 6 in place in the storage slot 12 to prevent longitudinal motion.

An actuator 14*a,b*, in this example, electric motors 14*a,b*, are provided and are operable to move the plurality of storage slots 12 vertically by turning the screw elements 13*a,b*. It is thereby possible to free the lowermost storage slot 12 for supply of another pipe while the previously loaded pipe 6 is moved to a higher storage slot 12 in the magazine 3. This allows the pipe lifting unit 5 to be designed for reaching the lowermost slot only for delivery or retrieval of pipes to or from the magazine 3.

Figure 6:
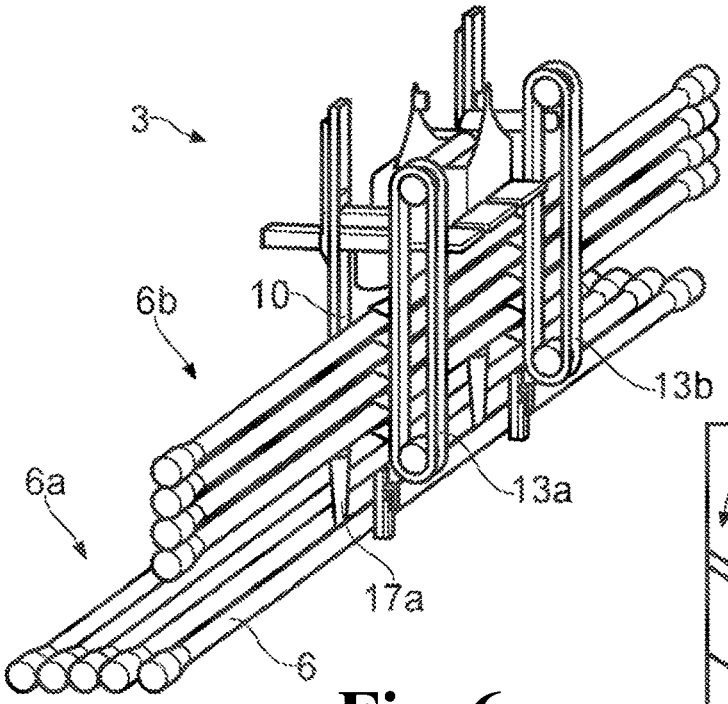
FIG. 6 shows a yoke magazine according to an embodiment of the present invention.
Figure 7:
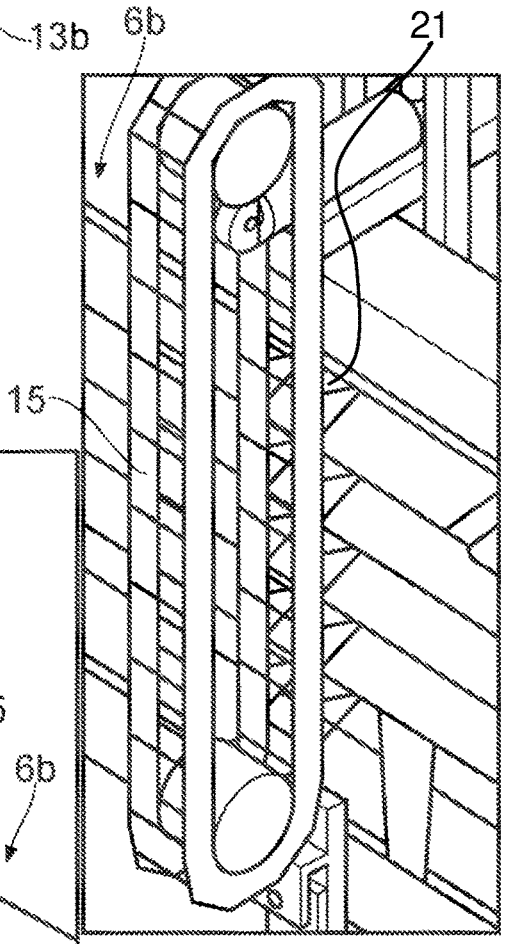
FIG. 7 shows a detailed view of FIG. 6 where the elongate storage elements comprise a vertically movable member having a plurality of support surfaces arranged thereon.
Figure 8:
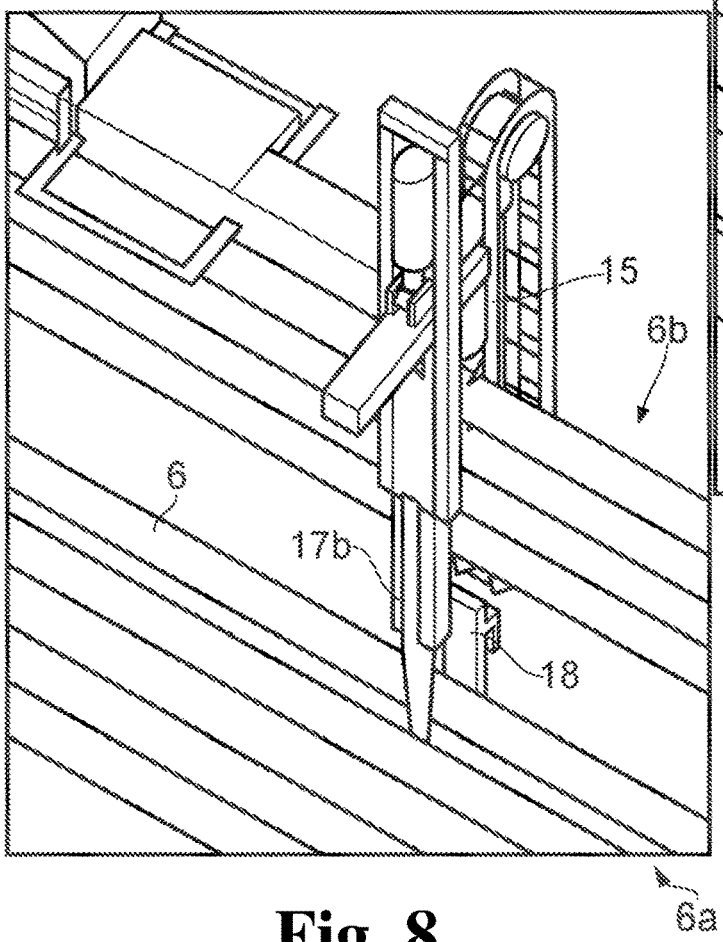
FIG. 8 shows a detailed view of a lifting cylinder of FIG. 6.

FIGS. 6-8 illustrate another embodiment of a magazine 3. In this embodiment, the screw elements 13*a,b* comprise a vertically movable member 15 having a plurality of support surfaces 21 arranged thereon. In this embodiment, the vertically movable member 15 is an endless belt having support pieces fixed to the belt (most clearly visible in FIG. 7) for holding the pipe 6, however, the vertically movable member 15 may alternatively be, for example, one or more rigid elongate structures which are vertically movable.

FIGS. 6-8 shows the magazine 3 with a plurality of pipes 6*b* in the magazine 3, where the pipes 6*b* are held in place in storage slots 12 defined by support surfaces 21 provided by the support pieces fixed to (or integrated in) the belt 15. In the illustrated state, one pipe 6 is being picked up by the pipe lifting unit 5, and a plurality of further pipes 6*a* are provided in a pipe storage, for example, on a pipe deck.

The belt 15 is rotatable by an actuator (not shown) so that the storage slots 12 are vertically movable and the pipe lifting unit 5 only needs to supply a pipe 6 to, or to retrieve a pipe 6 from, the lowermost slot.

A support rail 10 (see also FIGS. 3 and 5) is used to provide radial support of the pipes 6*b* in the magazine 3, however, some other alternative arrangement can be used therefor. The support pieces may, for example, have a support surface which is shaped so as to also provide radial, horizontal support for the pipe. This may be done, for example, by the support surface having a depression such as a semi-circular depression in which the pipes 6*b* lie supported.

FIGS. 6-8 and 9-11 also illustrate an embodiment of a pipe lifting unit 5. In this embodiment, the lifting tool comprises two lifting cylinders 17*a,b* (see FIGS. 6 and 8), each having a lifting arm 20 with an end section 19 which is operable to engage an underside of the pipe 6 to be lifted and to lift the pipe 6 towards the storage slot 12.

Figure 10:
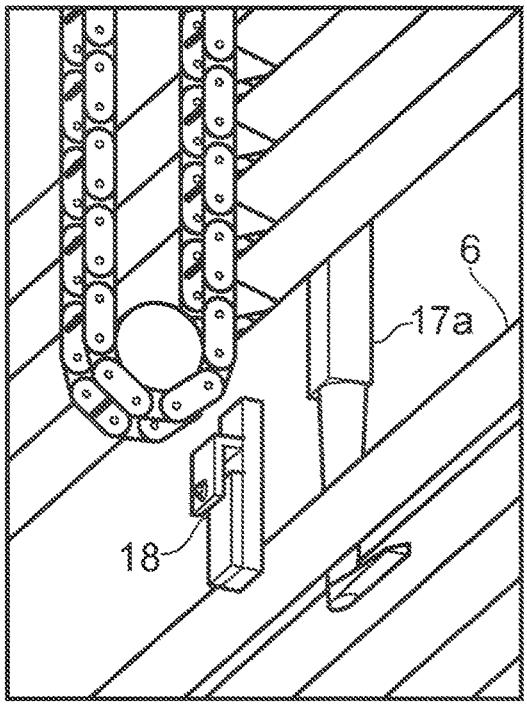
FIG. 10 shows how the lifting arm of the pipe lifting tool of FIG. 9 can be turned axially about 90° so that the end section is located under the pipe.
Figure 9:
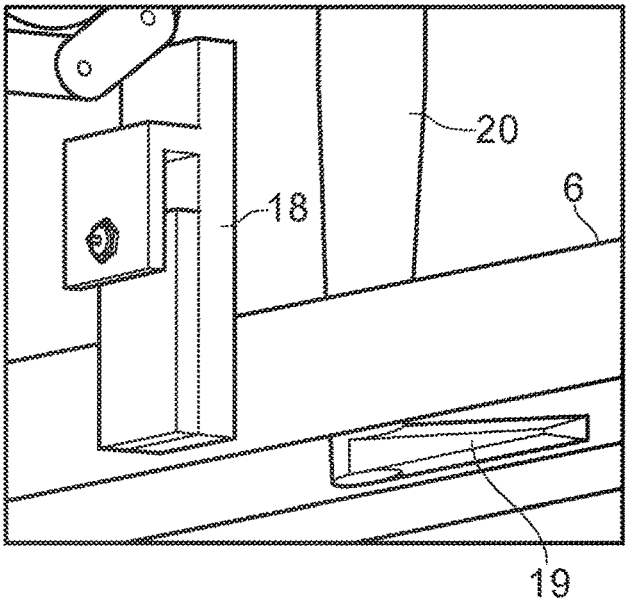
FIG. 9 shows a pipe lifting tool according to an embodiment of the present invention where the lifting arm is being lowered down so that the end section is located below the pipe to be lifted.
Figure 11:
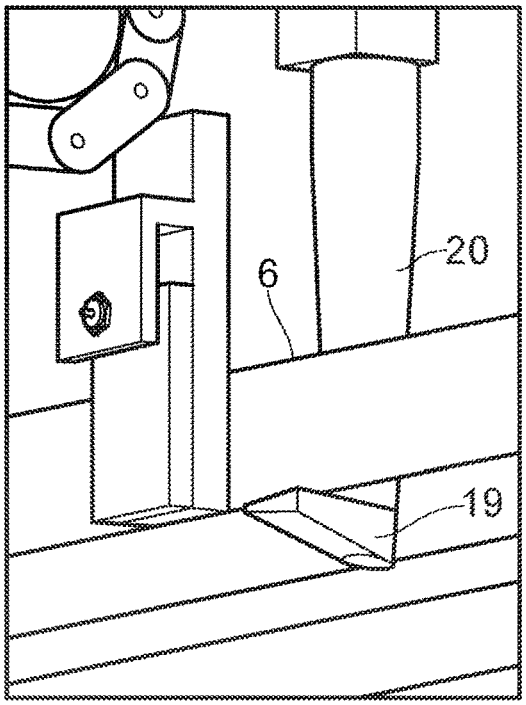
FIG. 11 shows how the lifting arm of the pipe lifting tool of FIG. 9 is then moved upwardly by the lifting cylinder to lift the pipe.

FIGS. 9-11 illustrate this process. FIG. 9 shows the lifting arm 20 being lowered down so that the end section 19 is located below the pipe 6 to be lifted. FIG. 10 shows how the lifting arm 20 can be turned axially about 90° so that the end section 19 is located under the pipe 6. FIG. 11 shows how the lifting arm 20 is then moved upwards by the lifting cylinder 17*a* to lift the pipe 6. A side support 18 is provided in this embodiment to prevent radial motion of the pipe 6 while being lifted. The end section 19 can alternatively be designed to also provide a sideways support for the pipe 6, for example, by having a depression (such as a semi-circular shaped depression) in the upward-facing surface of the end section 19 in which the pipe 6 can lie supported.

The lifting unit 5 is thus operable to lift the pipe 6 from, for example, a stored position on a pipe deck to the lowermost slot in the magazine 3. As can be seen in FIG. 10, in this embodiment, the vertically stacked storage slots 12 are located above the pipe lifting unit 5 so that when the lifting cylinder 17*a* lifts the pipe upwards, the lifting cylinder 17*a* can feed the pipe 6 into the lowermost storage slot in the belt arrangement.

Figure 12:
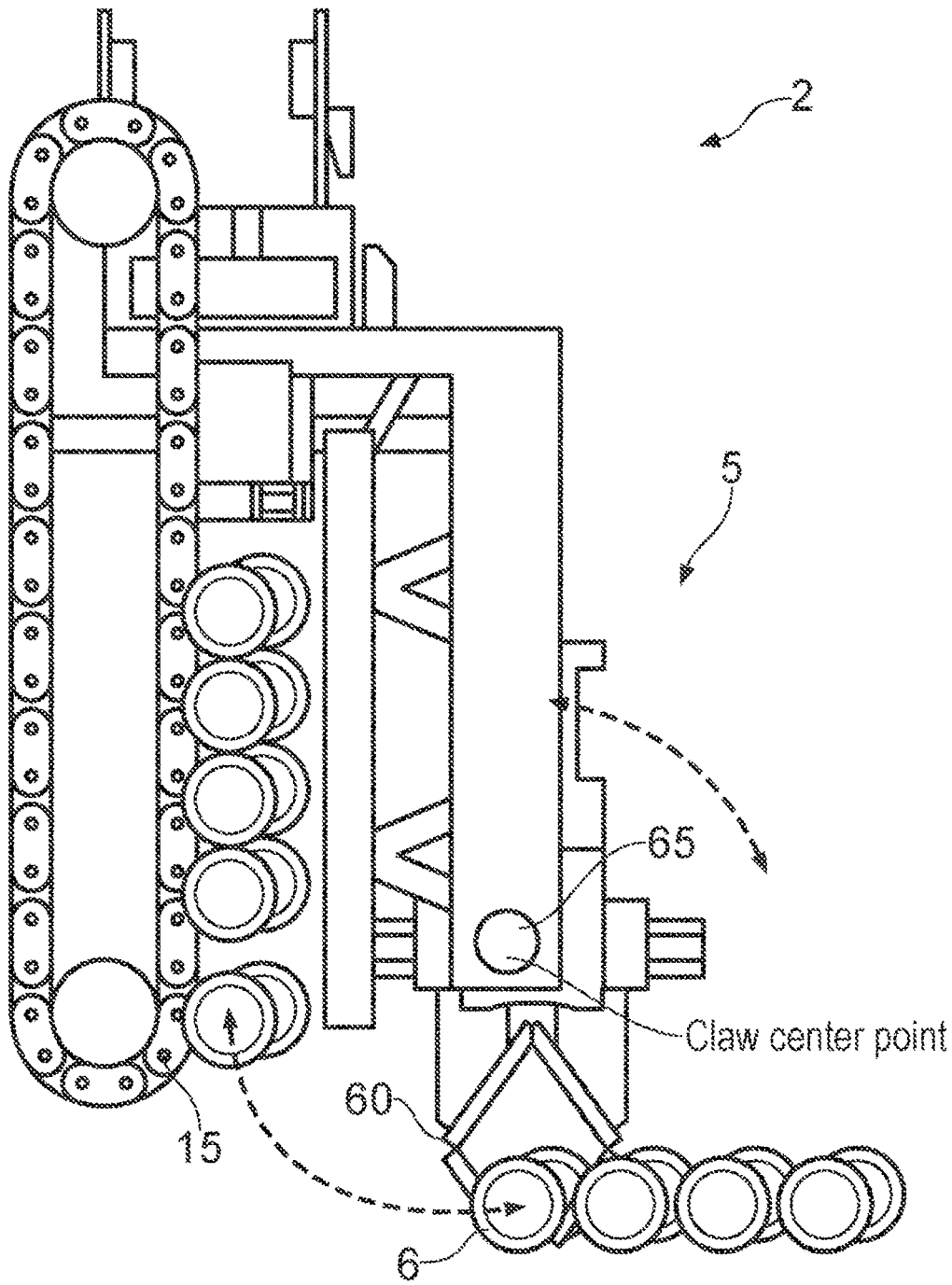
FIG. 12 shows an embodiment of a pipe lifting unit of the present invention in which a pipe clamp is used to engage the pipe.

FIG. 12 illustrates another embodiment of a pipe lifting unit 5. In this embodiment, a pipe clamp 60 is used to engage the pipe 6. The pipe clamp 60 is rotatable about an axis 65 so as to allow the pipe claim 60 to pick up a pipe 6 from a pipe deck and to supply the pipe 6 to a storage slot, in this case the lowermost storage slot, in the magazine 3. Two or more pipe clamps 60 may, optionally, operate in parallel and in tandem to engage and move the pipe 6. These may, for example, be spaced in the longitudinal direction of the pipe 6 to each grip one end section of the pipe 6.

Figure 13:
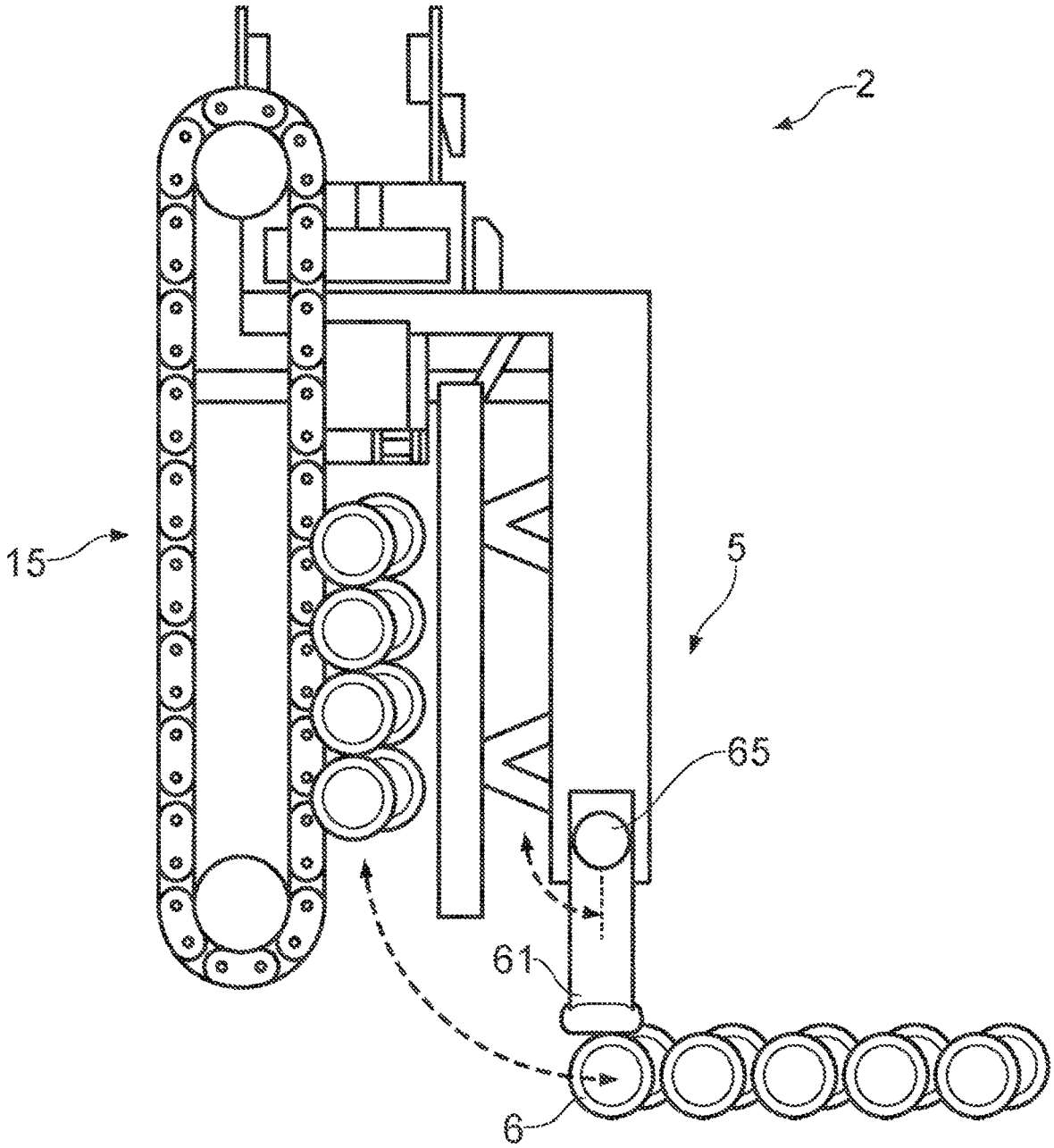
FIG. 13 shows an embodiment of a pipe lifting unit of the present invention in which a magnetic pipe lifting unit is used to engage the pipe.

FIG. 13 illustrates another embodiment of a pipe lifting unit 5. A magnetic pipe lifting unit 61 is used to engage the pipe 6 in this embodiment. The lifting unit 61 is rotatable about an axis 65 so as to allow the lifting unit 61 to pick up a pipe 6 from a pipe deck and to supply it to a storage slot, in this case the lowermost storage slot, in the magazine 3. The lifting unit 61 has a magnet, such as an electromagnet, arranged at a front section thereof, so that a pipe 6 can be engaged and held fixed by the lifting unit 61 when moving the pipe 6. Two or more magnets can be operated in parallel and in tandem to engage and move the pipe, for example, spaced in the longitudinal direction of the pipe 6.

Figure 14:
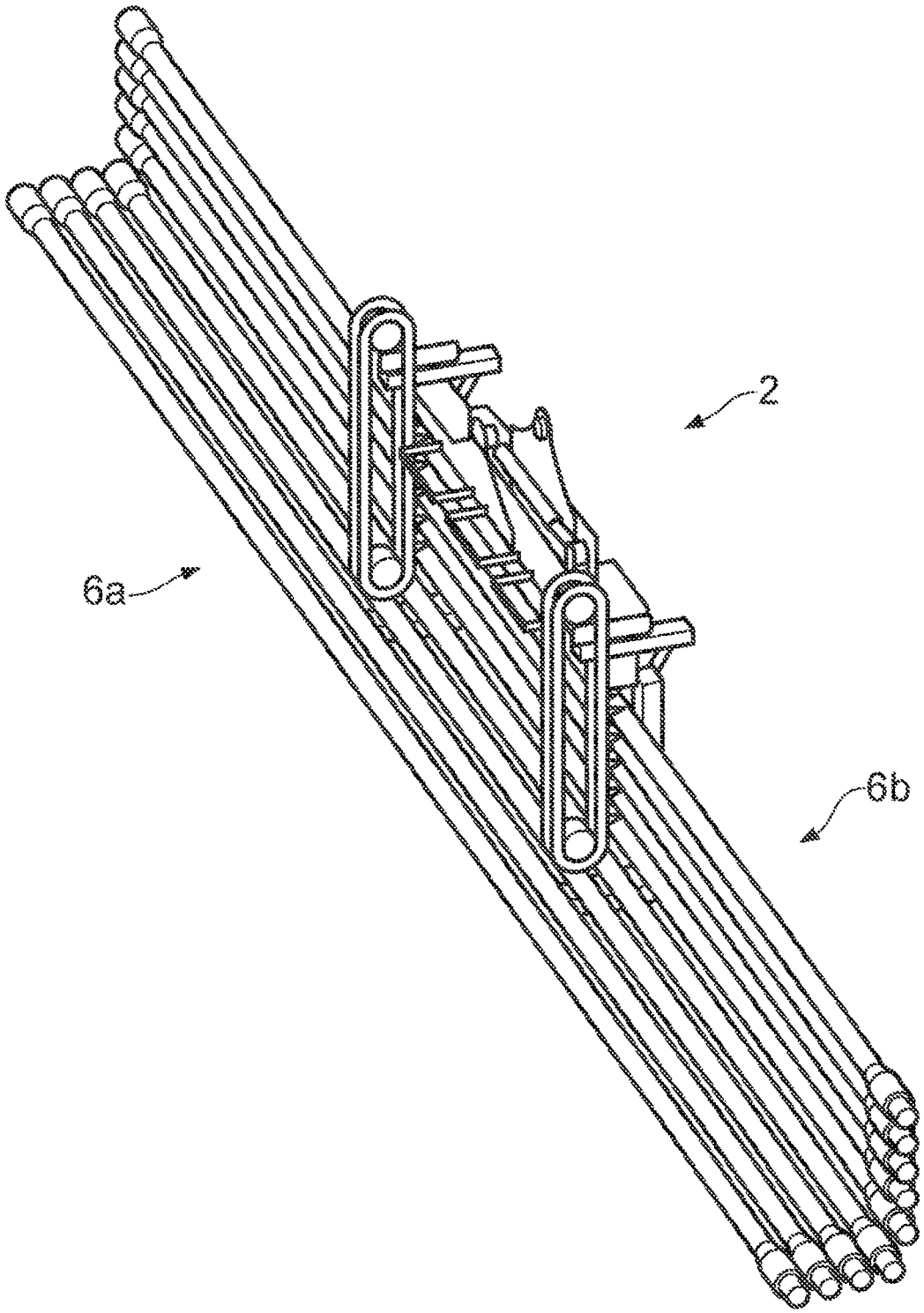
FIG. 14 shows a yoke according to an embodiment of the present invention.
Figure 15:
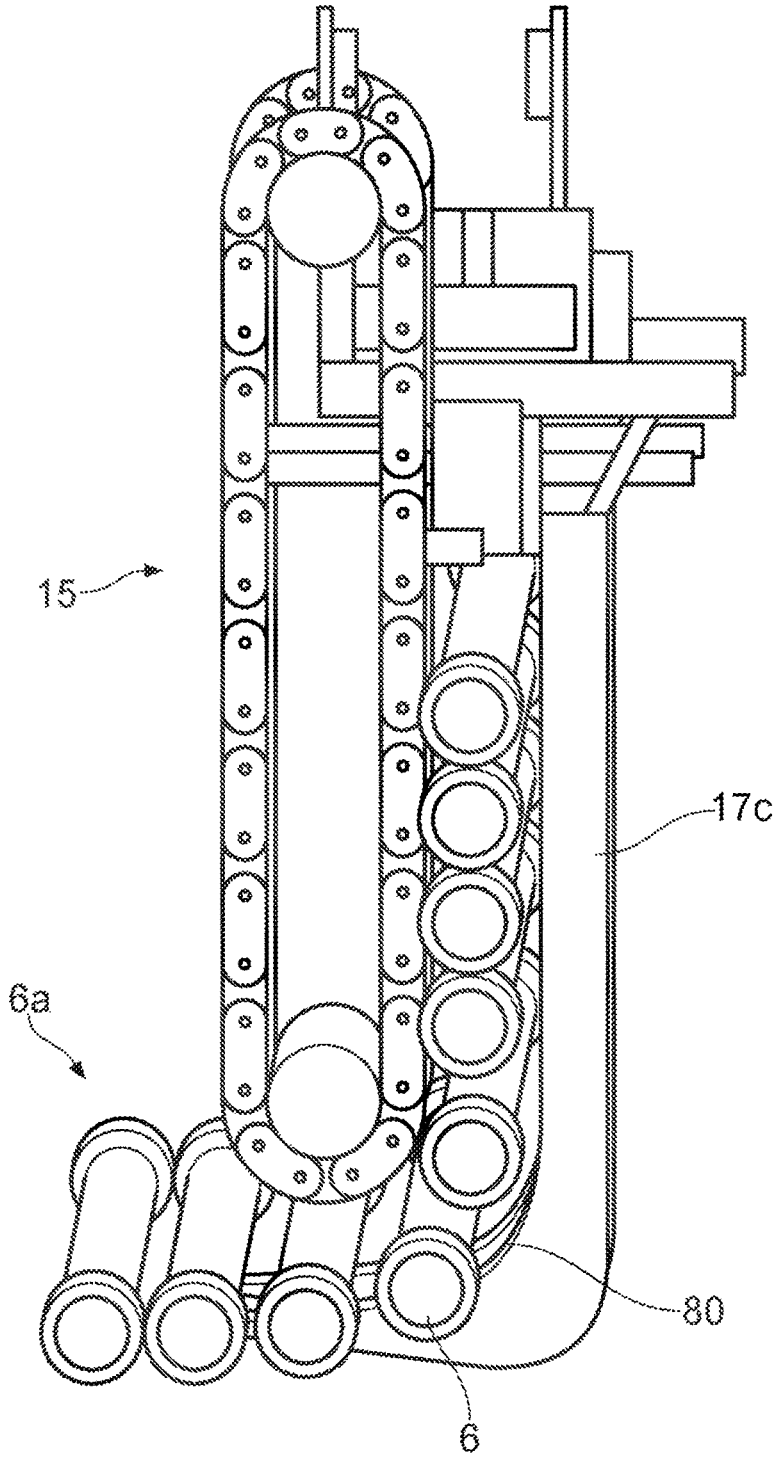
FIG. 15 shows a first detailed view of the belt and the lifting forks of the yoke of FIG. 14.
Figure 16:
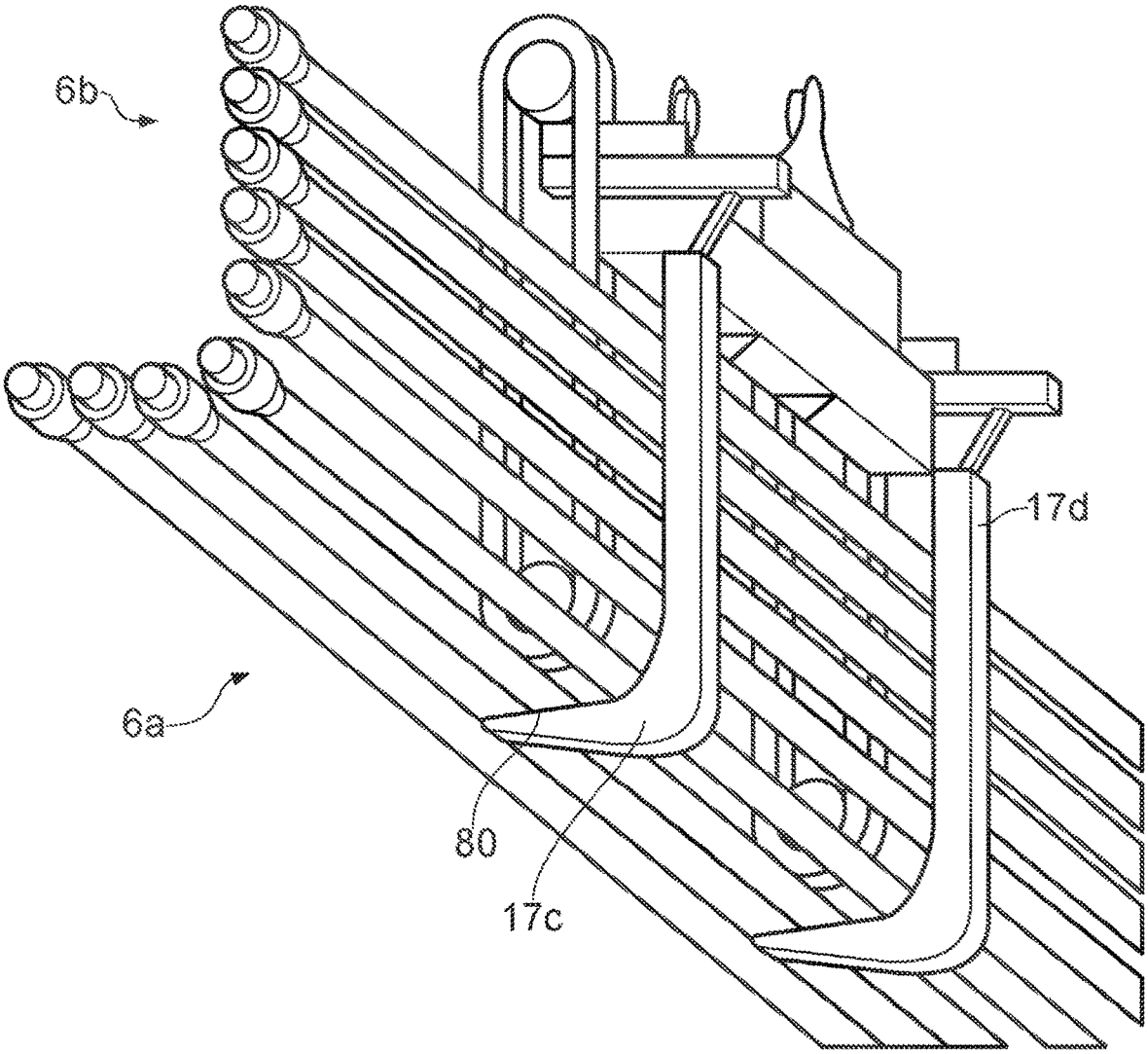
FIG. 16 shows a second detailed view of the belt and the lifting forks of the yoke of FIG. 14.
Figure 17:
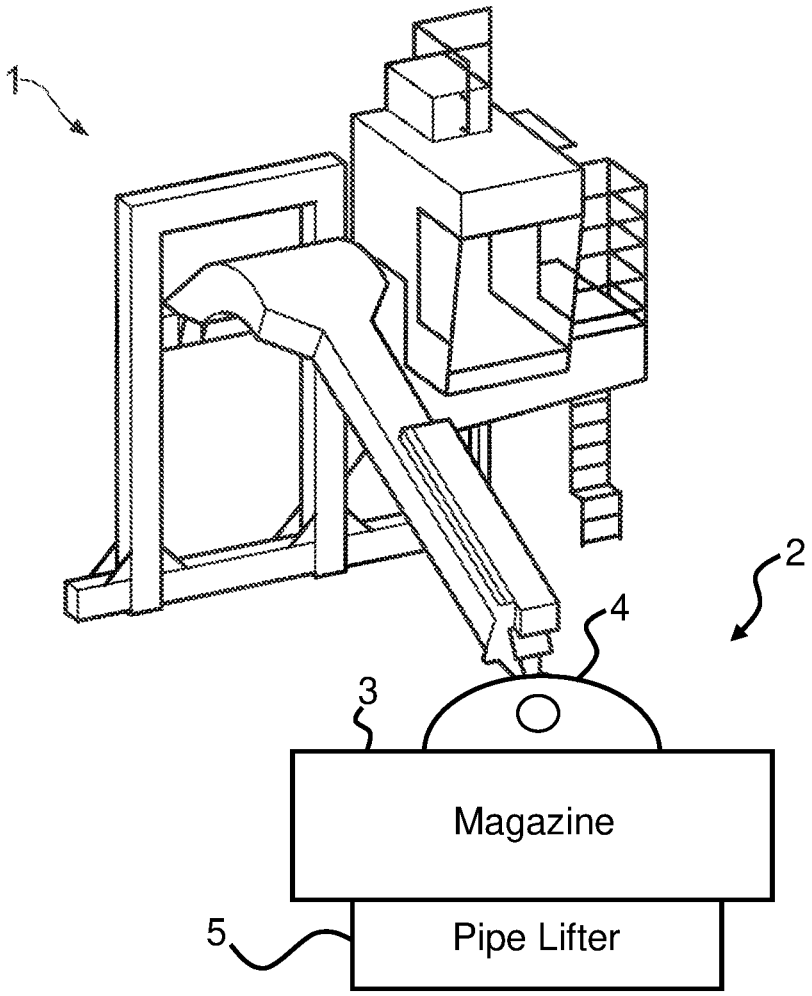
FIG. 17 shows a prior art pipe handling crane having a yoke according to an embodiment of the present invention.

FIGS. 14-16 show another embodiment of the pipe lifting unit 5, wherein the lifting unit 5 has a lifting tool comprising a lead surface 80 (see FIGS. 15 and 16) arranged to lead the pipe 6 into or out of a storage slot 12. The lifting tool in this embodiment comprises two lifting forks 17*c,d* which are fixed to the yoke 2 and are operable to be placed under at least one of the pipes 6*a* to be lifted from the pipe deck or to be laid down on the pipe deck. A lead surface 80 on the lifting forks 17*c,d* is configured to lead a pipe 6 to or from a storage slot in the magazine 3, in this case the belt 15. The pipe 6 can thereby be moved to the slot via a movement of the yoke 2 relative to the pipe 6 (and the pipe deck) by actuation of the magazine 3 (such as movement of the belt 15 or the screw elements 13*a,b*), or by a combination of the two. Such movement of the yoke 2 may including tilting the yoke 2 so as to move the pipe 6 towards the slot by gravity, whereby the pipe 6 can be locked in place in the storage slot. The lifting tool itself may thus be a passive tool, as illustrated in FIGS. 14-16, or it may be an actively actuated tool, such as those examples described in relation to FIGS. 6-13.

Although the above described embodiments have been shown with movable storage slots 12, it is also possible to use fixed slots and arrange the lifting member to be able to place the pipe in the respective slot. The pipe clamp 60 of FIG. 12 may, for example, be vertically movable in relation to the magazine 3 so that the pipe clamp 60 can access a plurality of storage slots in a vertical stack of storage slots, and place a pipe 6 in a storage slot or pick up a pipe from a storage slot.

In use, the yoke 2 according to embodiments described herein, thereby allows the pipe handling crane to pick up a plurality of pipes from, for example, a pipe deck, and to transport the plurality of pipes to, for example, a pipe handling machine associated with a drilling plant. An arrangement according to some embodiments may improve safety and operational flexibility on a drilling rig in that personnel will, for example, have greater freedom to work on the pipe deck without the pipe handling crane repeatedly returning to pick up a new pipe. A longer period may be available between each trip by the pipe handling crane with the arrangement described herein. A reduced number of trips may also extend the working lifetime of the crane and associated systems, thereby reducing maintenance requirements.

The present invention is not limited by the embodiments described above; reference should be had to the appended claims.

What is claimed is:

1. A yoke for a pipe handling crane, the yoke comprising:

a magazine comprising a plurality of storage slots for tubular pipes; and a pipe lifting unit comprising a lifting tool, the lifting tool being configured to supply one of the tubular pipes to and retrieve one of the tubular pipes from the magazine, the lifting tool comprising, a lifting member comprising a pivotable end section, the pivotable end section being configured to rotate in a horizontal plane so as to engage an underside of one of the tubular pipes so that the lifting member can vertically lift the one of the tubular pipes to one of the plurality of storage slots of the magazine, or a tong which is configured to engage an outer surface of one of the tubular pipes and to lift the one of the tubular pipes to one of the plurality of storage slots of the magazine, or a magnetic lifting unit which is configured to engage an outer surface of one of the tubular pipes and to lift the one of the tubular pipes to one of the plurality of storage slots of the magazine, wherein, the yoke is connected to the pipe handling crane so as to move relative to a pipe deck on a drilling rig, and the magazine is arranged above the pipe lifting unit.

2. The yoke as recited in claim 1, wherein the plurality of storage slots are arranged as a vertical column of slots.

3. The yoke as recited in claim 1, wherein, the plurality of storage slots are provided by a first elongate element and a second elongate element, each of the first elongate element and the second elongate element being arranged vertically, each of the first elongate element and the second elongate element comprises a plurality of support slots, each support slot of the plurality of support slots is configured to support one of the tubular pipes, and one support slot of the first elongate element and one support slot of the second elongate element together provides a pair of support slots which makes up one of the plurality of storage slots.

4. The yoke as recited in claim 3, wherein, the first elongate element comprises a vertically movable member which comprises a plurality of support surfaces arranged thereon, and the second elongate element comprises a vertically movable member which comprises a plurality of support surfaces arranged thereon.

5. The yoke as recited in claim 4, wherein the vertically movable member is a belt.

6. The yoke as recited in claim 3, wherein, the first elongate element comprises a screw which comprises a helix-shaped support surface, and the second elongate element comprises a screw which comprises a helix-shaped support surface.

7. The yoke as recited in claim 3, wherein the first elongate element comprises an actuator which is configured to move the plurality of storage slots vertically, and the second elongate element comprises an actuator which is configured to move the plurality of storage slots vertically.

8. The yoke as recited in claim 1, further comprising:

at least one vertical support rail which is arranged to provide a radial support for the tubular pipes arranged in the magazine.

9. The yoke as recited in claim 1, further comprising:

at least one end support which is arranged to provide a longitudinal support for the tubular pipes arranged in the magazine.

10. The yoke as recited in claim 1, wherein the lifting tool comprises a lead surface which is configured to lead one of the tubular pipes into or out of one of the plurality of storage slots of the magazine.

11. A pipe handling crane comprising the yoke as recited in claim 1.

12. The pipe handling crane as recited in claim 11, wherein the pipe handling crane is arranged to move one of the tubular pipes to the pipe deck on the drilling rig or from the pipe deck on the drilling rig.

13. A method of moving a plurality of pipes between a pipe storage and a drilling operation, the method comprising:

operating a pipe handling crane comprising the yoke as recited in claim 1 to, pick up the plurality of pipes from the pipe storage and to store the plurality of pipes in the magazine, and deliver the plurality of pipes from the magazine to a pipe handling machine which is associated with the drilling operation.

14. A pipe handling crane comprising a yoke, the yoke comprising:

a magazine comprising a plurality of storage slots for tubular pipes; and a pipe lifting unit comprising a lifting tool, the lifting tool being configured to supply one of the tubular pipes to and retrieve one of the tubular pipes from the magazine, the lifting tool comprising, a lifting member comprising a pivotable end section, the pivotable end section being configured to rotate in a horizontal plane so as to engage an underside of one of the tubular pipes so that the lifting member can vertically lift the one of the tubular pipes to one of the plurality of storage slots of the magazine, or a tong which is configured to engage an outer surface of one of the tubular pipes and to lift the one of the tubular pipes to one of the plurality of storage slots of the magazine, or a magnetic lifting unit which is configured to engage an outer surface of one of the tubular pipes and to lift the one of the tubular pipes to one of the plurality of storage slots of the magazine, wherein, the magazine is arranged above the pipe lifting unit, the pipe handling crane is arranged to move one of the tubular pipes to a pipe deck on a drilling rig or from the pipe deck on the drilling rig, and the yoke of the pipe handling crane is movable relative to the pipe deck.

15. A pipe handling crane comprising a yoke, the yoke comprising:

a magazine comprising a plurality of storage slots for tubular pipes; and a pipe lifting unit comprising a lifting tool, the lifting tool being configured to supply one of the tubular pipes to and retrieve one of the tubular pipes from the magazine, wherein, the magazine is arranged above the pipe lifting unit, the pipe handling crane is arranged to move one of the tubular pipes to a pipe deck on a drilling rig or from the pipe deck on the drilling rig, and the yoke of the pipe handling crane is movable relative to the pipe deck.

* * * * *